US011118763B2

(12) United States Patent
Langbein

(10) Patent No.: US 11,118,763 B2
(45) Date of Patent: Sep. 14, 2021

(54) SYSTEM COMPRISING AN ILLUMINATION COMPONENT

(71) Applicant: DARK MATTERS GMBH, Berlin (DE)

(72) Inventor: Johannes Langbein, Berlin (DE)

(73) Assignee: DARK MATTER GMBH, Berlin (DE)

( * ) Notice: Subject to any disclaimer, the term of this patent is extended or adjusted under 35 U.S.C. 154(b) by 0 days.

(21) Appl. No.: 16/845,680

(22) Filed: Apr. 10, 2020

(65) Prior Publication Data

US 2020/0326055 A1 Oct. 15, 2020

(30) Foreign Application Priority Data

Apr. 11, 2019 (EP) ..... 19168645

(51) Int. Cl.

| | |
|---|---|
| ***F21V 17/00*** | (2006.01) |
| ***F21V 17/08*** | (2006.01) |
| ***F21S 8/06*** | (2006.01) |
| ***F21V 21/16*** | (2006.01) |
| ***F21V 23/00*** | (2015.01) |
| ***F21V 23/06*** | (2006.01) |

(52) U.S. Cl.

CPC ..... *F21V 17/08* (2013.01); *F21S 8/061* (2013.01); *F21V 21/16* (2013.01); *F21V 23/001* (2013.01); *F21V 23/06* (2013.01)

(58) Field of Classification Search

CPC ..... F21V 17/08; F21V 21/16; F21V 23/001; F21V 23/06; F21V 21/38; F21V 21/36; F21V 21/008; F21S 8/06; F21S 8/061

See application file for complete search history.

(56) References Cited

U.S. PATENT DOCUMENTS

| | | | | |
|---|---|---|---|---|
| 10,240,766 | B1 * | 3/2019 | Woodworth | F21V 21/36 |
| 2009/0296412 | A1 * | 12/2009 | Ogawa | F21S 8/06 362/419 |
| 2011/0116254 | A1 | 5/2011 | Workman et al. | |
| 2017/0153013 | A1 * | 6/2017 | Balkaya | F21V 21/16 |
| 2020/0239287 | A1 | 7/2020 | Volohovs | |

FOREIGN PATENT DOCUMENTS

| | | |
|---|---|---|
| EP | 2466252 BI | 7/2013 |
| EP | 3450385 A1 | 3/2019 |
| KR | 1020110012878 A | 2/2011 |

OTHER PUBLICATIONS

Machine assisted English translation of KR1020110012878A obtained from https://patents.google.com/patent on Apr. 9, 2020, 7 pages.

* cited by examiner

*Primary Examiner* — Y M. Quach Lee

(74) *Attorney, Agent, or Firm* — Warner Norcross + Judd LLP

(57) ABSTRACT

Disclosed is a system comprising an illumination component, an electrical apparatus, a cable configured to be mechanically connected to the illumination component, a winch configured to wind and/or unwind the cable, and a connector device comprising a bearing and configured to mechanically connect the illumination component to the cable in such a manner that, in a connected state, at least part of the illumination component is rotationally decoupled from the cable via the bearing. The system is configured to supply power and/or data to the illumination component via the cable.

15 Claims, 6 Drawing Sheets

SYSTEM COMPRISING AN ILLUMINATION COMPONENT

CROSS-REFERENCE TO RELATED APPLICATIONS

This application claims priority to and all advantages of European Patent Application No. 19168645.0, filed on 11 Apr. 2019, the content of which is hereby incorporated by reference.

FIELD OF THE INVENTION

The invention is directed to a system comprising an illumination component, a cable configured to be mechanically connected to the illumination component, in particular comprising an electrical apparatus, and a winch configured to wind and/or unwind the cable, wherein the system is configured to supply power and/or data to the illumination component via the cable.

BACKGROUND OF THE INVENTION

It is known to provide such an illumination component, in particular, comprising electrical apparatus like a lighting apparatus, in such a manner that it is mechanically and electrically connected to a cable. In such a configuration, the cable can be used to mechanically attach the illumination component to its surroundings via the winch. Usually, the cable is wound around the winch and the winch may be attached to any desired element in said surroundings. By winding or unwinding the cable, the length of unwound cable can be adjusted. Thus, when a force, for example gravity or any other force pulling against the cable, acts on the illumination component such that the cable is tensioned, for example in case that the illumination component is suspended via the cable, it is possible, by adjusting the length of the unwound cable, to allow for a controlled change of the position of the illumination component. At the same time, the system can supply power and/or data to the illumination component via the cable, usually via a wiring, which is enclosed in a sheath of the cable.

Such a system has been described in EP 2 466 252 B1, for example.

Although such a system is generally reliable, some situations occur when wear of some of the system parts, particularly the cable itself, was higher than expected, or inexplicable damages occurred.

The inventors have found that in some situations, in particular when the position is changed rapidly, the cable will become twisted and that the above problems can, at least in part, be attributed to this twisting of the cable. That is, it was found that unexpectedly high mechanical strain on the cable occurs in systems as described above, leading to higher wear of and/or damages to the cable.

A system is proposed in EP 3 450 385 A1, wherein an object is suspended from a winch using a rope, the rope and the object being connected using a spin prevention device. However, in the system shown in this document, it is only possible to provide external power when the object is in contact with a power supply board, which has an essentially fixed position. The power supply board is then used to charge a battery, which may power the object in operation. Accordingly, continuous supply with external power or data is not possible in operation.

In view of the above, the problem underlying the invention is to provide a system that still allows for continuous supply with external power and/or data during operation, in which the risk for damages to and increased wear of the cable is reduced.

SUMMARY

Disclosed is a system comprising an illumination component, a cable configured to be mechanically connected to the illumination component, in particular comprising an electrical apparatus, and a winch configured to wind and/or unwind the cable, and configured to supply power and/or data to the illumination component via the cable. The system further comprises a connector device comprising a bearing and configured to mechanically connect the illumination component to the cable in such a manner that, in a connected state, at least part of the illumination component is rotationally decoupled from the cable via the bearing.

It was found by the inventors that twisting may result from the illumination component and cable rotating around the axis extending along the longitudinal axis of the unwound and tensioned portion of the cable, particularly when the position of the illumination component is changed rapidly. It was further found that the cable without an illumination component attached to it will generally not twist much and, if it does, will return to an untwisted condition in a shorter length of time than when the illumination component is attached to it. The inventors attributed this to at least some parts of the illumination component usually having a significantly higher mass and/or moment of inertia than the cable.

The invention, in particular the connector device being configured to mechanically connect the illumination component to the cable in such a manner that the cable is rotationally decoupled from at least part of the illumination component, allows for the cable to barely twist up and, if twisted at all, to untwist faster, thus reducing the above-described negative effects of the twisting.

Furthermore, it was found that due to the twisting, the precision of controlling the position of the illumination component may also suffer. That is, the effective length of unwound cable may shorten unpredictably, depending on how much twist has occurred. Moreover, in some cases the twisted cable may also show different characteristics, when compared to a cable that is not twisted, when winding it on the winch. In ideal conditions, the cable and winch will be configured so as to allow for adjacent turns of the cable coil on the winch to be neatly aligned. However, when the cable is twisted, this neat alignment may in some cases be impeded by the twisted cable. This applies to different types of cables, including but not limited to round cables, for example having a circular or oval cross-section, and cables having a cross-section that is rectangular or rectangular with rounded-down corners, in particular flat cables. Moreover, in conventional systems, the winch and cable often are dimensioned such that the cable has little play when wound on the winch. Any twisting may therefore lead to additional mechanical friction between winch and cable, which reduces precision of the control of the position and may even jam the winch. It may also damage the winch.

Some of the configurations of the system described herein may alleviate one or more of the above problems in addition to reducing the risk for damages to and increased wear of the cable. That is, the risk of damage to the winch may be reduced and/or the risk of jamming during operation may be reduced and/or the positioning precision of the illumination component may be improved. Operation herein is meant to comprise changing the position of the illumination component by winding and/or unwinding the winch.

The part of the illumination component from which the cable is decoupled will herein be referred to as the decoupled part of the illumination component or, in abbreviated from, as the decoupled part.

All features pertaining to connections, coupling, or decoupling refer to a connected state, where the cable is mechanically and, where applicable, electrically, connected to the illumination component, unless otherwise specified. Moreover, unless specified otherwise, the system is described herein in an assembled state and in the arrangement, in particular mounting, corresponding to its designated use.

The connector device being configured to connect the illumination component to the cable may comprise that the cable is attached directly to the connector device and/or directly to another element, in particular a non-decoupled part of the illumination component. For example, a first, non-decoupled part of the illumination component may be directly attached to the cable and to a first portion of the connector device, and a second, decoupled part of the illumination component may be attached, directly or indirectly, to a second portion of the connector device, the two portions being rotationally decoupled. This would still be considered as the connector device connecting the cable and the illumination component, although the cable may be attached to some part of the illumination component directly and possibly may even only indirectly be attached to the first portion of the connector device.

Rotationally decoupled means that a rotation of the decoupled part of the illumination component is decoupled from the cable irrespective of the amount of rotation of the decoupled part. For example, even a rotation of 360° or more is decoupled. In other words, the connector device is configured so as to avoid that a rotation of the decoupled part, irrespective of the amount of rotation, is translated to a rotation of the cable. The rotation shall refer to a rotation around an extension of the longitudinal axis (i.e., the axis along its biggest expansion) of the unwound and tensioned portion of the cable. Twisting of the cable refers to a torsion of the cable around said longitudinal axis in the unwound portion of the cable.

The shape of the cross-section of the cable is not particularly limited. In particular, the cable may be a round cable, for example having a circular or oval cross-section, or a cable having a rectangular or rectangular with rounded-down corners cross-section. In particular, the cable may be a flat cable.

The cable is configured to provide power and/or data, for example electrical signals, to the illumination component. The cable may comprise a sheath and wirings. The wirings may be used for the power and/or data transfer.

The system described herein, in particular when it comes to the cable-winch arrangement, may be based on the system as described in the patent document EP 2 466 252 B1. In particular, the winch described herein may be configured to wind and/or unwind the cable so as to provide a predetermined length of unwound cable. The winding and unwinding may be achieved by driving means driving the winch, e.g., controlled by a controller.

The illumination component may comprise an electrical apparatus and the system is configured to supply power and/or data to the electrical apparatus via the cable and, optionally, via the connector device. In particular, the connector device may be configured to transmit power and/or data from the cable to the illumination component.

The bearing may, for example, comprise a ball bearing or a roller bearing.

In any of the systems described herein and, particularly, in the above described case, the connector device may comprise, or be mechanically connected, with a strain relief element, which is configured to guide the cable in such a way that strain on the electrical connection between the cable and the illumination component is reduced compared to a system not having such a strain relief. In particular, the strain relief element may be configured such that the mechanical strain on the wirings of the cable and/or the wirings of the electronic device and/or a plug connecting the wirings is reduced. The illumination component may then be mechanically attached to the strain relief element via the connector device and/or any non-decoupled part of the illumination component may be mechanically attached to the strain relief element directly. The cable may be mechanically attached to the strain relief element in such a manner that a free end of the cable is provided, which, in a connected state, provides the connection to the illumination component, directly or via the connector device. A free end of the cable is an end that is not tensioned.

The illumination component may comprise at least a first part and a second part and the connector device may be configured to rotationally decouple the first part and the second part from the cable or to rotationally decouple only the second part from the cable. In particular, where the illumination component comprises more than two parts, the connector device may be configured to rotationally decouple only one, several, or all of said parts from the cable.

In case both the first and the second part are decoupled from the cable, they may be attached to each other and/or both attached to the same bearing. Alternatively, each of the first and second part may be rotationally decoupled independently of each other. In such a case, the parts may be rotationally decoupled by means of separate bearings.

As seen above, in particular, only the second part may be decoupled from the cable. In such a case, in particular, the second part may have a bigger mass and/or moment of inertia than the first part. The risk of the cable twisting increases with the mass and moment of inertia of any object that is fixedly attached to its end. Therefore, when only part of the illumination component is decoupled, it is advantageous that this be the heavier part thereof and/or the one with the bigger moment of inertia.

The connector device still allows for other, e.g., non-decoupled, parts of the illumination component to be attached directly to the cable or to the portion of the connector device that is attached to the cable. In such a configuration, a non-moving electrical connection between the cable and said part having a lower mass or moment of inertia can be achieved with ease. One scenario where this is particularly advantageous is, when the illumination component comprises a light-emitting device. Such a device, as such, may be relatively lightweight, as it may only comprise a bulb or LED element, for example. The risk of the cable twisting will not be greatly increased when this light-emitting device is not rotationally decoupled from the cable and at the same time, the electrical connection can be made easily by means of plug connections, for example. Moreover, in cases where the light-emitting device is arranged in a direction extending along the longitudinal axis of the unwound portion of the cable, it is likely to have a lower moment of inertia than other parts of the illumination component, for example a shell or lampshade.

In the above described systems, the cable may be attached to a first portion of the connector device, in particular in a fixed relative position, the decoupled part of the illumination component may be attached to a second portion of the connector device, in particular in a fixed relative position, and the first and second portion of the connector device may be freely rotatable with respect to each other.

That is, the connector device is configured such that, irrespective of the amount of rotation, the first portion is rotationally decoupled from the second portion. This may be achieved, for example, by means of the bearing and the two portions being attached to two respective parts of the bearing.

A fixed relative position particularly means that there is no relative movement between the attached elements.

The cable and/or decoupled part may be attached to the respective portion by means of detachable connections, for example positive form locking, plug connections, screw connections, or the like. In case of attaching the cable to the connector device, in addition to or alternatively to these connections, as described above, it is possible to attach the cable to a strain relief, which may be part of the connector device or external to the connector device. In particular, the first portion of the connector device may comprise or be connected to such a strain relief.

In the above systems, the first portion of the connector device may be attached to the first part of the illumination component, particularly in a fixed relative position, and the second portion of the connector device may be connected to the second part of the illumination component, particularly in a fixed relative position.

As a result, the first part of the illumination component is rotationally decoupled from and, accordingly, freely rotatable with respect to, the second part of the illumination component.

The attachment may, for example, be achieved by any of the attachment means described above. The illumination component may comprise an electrical apparatus and the above-described first part of the illumination component may comprise parts of the electrical apparatus to be supplied with power and/or data via the cable. As described above, the first part may not be decoupled from the cable. The first part may comprise a light-emitting device comprising one or more light-emitting elements, for example an LED, an LED panel, lightbulb, fluorescent tube or the like, and, optionally, a controller configured to control the light-emitting elements.

The parts of the electrical apparatus to be provided with power and/or signals via the cable may have an electrical connection with the cable, the connection bypassing the connector device, in particular a direct connection between a wiring of the cable and a wiring of the electrical apparatus.

For example, a wiring of the cable may be connected with a wiring of the electrical apparatus by means of a plug connection, without involving any elements of the connector device. As an example, the wiring from the cable or attached to the cable may bypass the connector device by extending around it.

As described above, the illumination component may comprise an electrical apparatus. The system may be configured to transmit power and/or data from the cable to the electrical apparatus via the connector device.

This can be achieved, for example, by means of a connection of the above-described first portion of the connector device with the cable, e.g., a plug connection, and by means of a connection of the above-described second portion of the connector device with the parts of the electrical apparatus to be provided with power and/or data via the cable. These connections, in particular, may be configured such that they do not require a gliding connection or contactless interface. Accordingly, different illumination components and cables can easily be combined without any special requirements, since it is possible for the connector device to provide, where necessary, a gliding connection or contactless interface, irrespective of the elements attached thereto.

The connector device may comprise an electrical contact, e.g., a gliding contact, electrically connecting the first portion and the second portion of the connector device, and/or a contactless transfer interface, e.g., coils, configured to transfer power and/or data between the first portion and the second portion of the connector device.

Thus, the connector device allows for providing power and/or data essentially without impeding the decoupling. An example for a gliding contact comprises a slip ring arrangement. An example for contactless transfer is transfer via coils by means of electromagnetic induction.

In any of the above described systems, the illumination component may comprise a lighting apparatus having a light-emitting device and a shell, wherein the shell at least partially encloses the light-emitting device, and wherein the above-described first part, i.e., the part that may be, but is not necessarily, decoupled from the cable, comprises the light-emitting device and the second part, i.e. the part that is decoupled from the cable, comprises the shell.

In such a system, the connector device allows for rotationally decoupling the light-emitting device and the shell from the cable or for rotationally decoupling only the shell from the cable.

The shell may be at least partially transparent or translucent, such that light emitted by the light-emitting device may be emitted through the shell. In particular, the shell may comprise a lampshade.

The form of the shell is not limited, but it may, for example, be tube-shaped, spherical, or cuboid. The shell may be constituted by one or more of glass, plastic, paper, and textile.

In any of the above systems, the illumination component may comprise a or the lighting apparatus comprising a or the light-emitting device, and a or the shell, wherein the shell at least partially encloses the light-emitting device, and wherein the connector device is configured to rotationally decouple, in particular only, the shell from the cable. The system may in such a case be further configured such that power and/or data are provided from the cable to the light-emitting device by means of an electrical contact and/or by means of a contactless transfer interface for transferring power and/or data, e.g., via coils, as has been described in a different context above and is equally applicable in this specific context.

In this example, the connector device may comprise the electrical contact and/or contactless transfer interface for transferring power and/or data. However, it is also conceivable that the system comprises alternative or additional electrical contacts or interfaces.

In any of the above-described configurations of the systems, the illumination component may comprise at least one of a light-reflecting element, a diffusor, a fluorescent element, and a phosphorescent element. In particular, the illumination component may comprise a mirror and/or, as seen above, an electrical apparatus like a lighting apparatus.

In any of the above-described configurations of the systems, when the system is assembled and mounted for its designated use, the winch may be mounted to a building, for example the walls and or ceiling thereof, in particular on the inside of the building, and/or to a rack or a framework or a beam, in particular mounted on the inside of a or the building. A framework on which the winch is mounted may be a scaffold or may be suspended from the ceiling. The inside of a building may comprise a hangar, lobby, hallway or the like.

In any of the above-described configurations of the system, when the system is assembled and mounted for its designated use, the cable may be tensioned, for example by a force directed away from the winch, in particular gravity.

Alternatively or in addition thereto, in any of the above-described configurations of the system, when the system is assembled and mounted for its designated use, the illumination component may be suspended, via the cable, from the winch, which is in particular mounted to at least one of a ceiling, a rack, a framework, and a beam.

Any of the above-described systems may be used in an arrangement of a plurality of systems each comprising a winch, a cable, and an illumination component, particularly a plurality of systems as described above. In particular, the plurality of systems may be arranged adjacently to each other, for example in a line or an array. In particular, the arrangement may further comprise a controller and the systems may be connected to the controller via a data connection, the controller configured to control the operation of the winches, e.g. to wind and/or unwind a predetermined length of the cable, and optionally the operation of the illumination components, in a coordinated manner.

It should be noted that in such an arrangement, a precise control of the effective length of the cable is particularly important, so as to ensure that the illumination components are moved by a precise amount that is determined by the controlled operation of the winches to wind and/or unwind the cable. Accordingly, avoiding that the cable is twisted is advantageous in that it allows for avoiding deviations in the effective length of the unwound portion of the cable.

The above described systems and arrangement may for example be used for installations that comprise illumination components, which may, for example, be lighting elements or may be irradiated with external light sources to provide illumination by means of reflection or phosphorescence for example. In particular, such installations may be provided indoors, particularly in high-ceilinged halls or the like. A coordinated operation of the winches and the external light sources and/or illumination components in the form of lighting elements may be used for light shows, in particular such that changing geometrical forms may mimicked with a plurality of illumination components. Thus, a precise control of the position of the illumination components is particularly important in such scenarios. Accordingly, avoiding that the cable is twisted is advantageous in that it allows for avoiding deviations in the effective length of the unwound portion of the cable.

BRIEF DESCRIPTION OF THE DRAWINGS

Further examples of the invention will be described below with reference to the attached figures.

DETAILED DESCRIPTION

In the following, for the same or similar elements, the same reference signs will be used.

Figure 1:
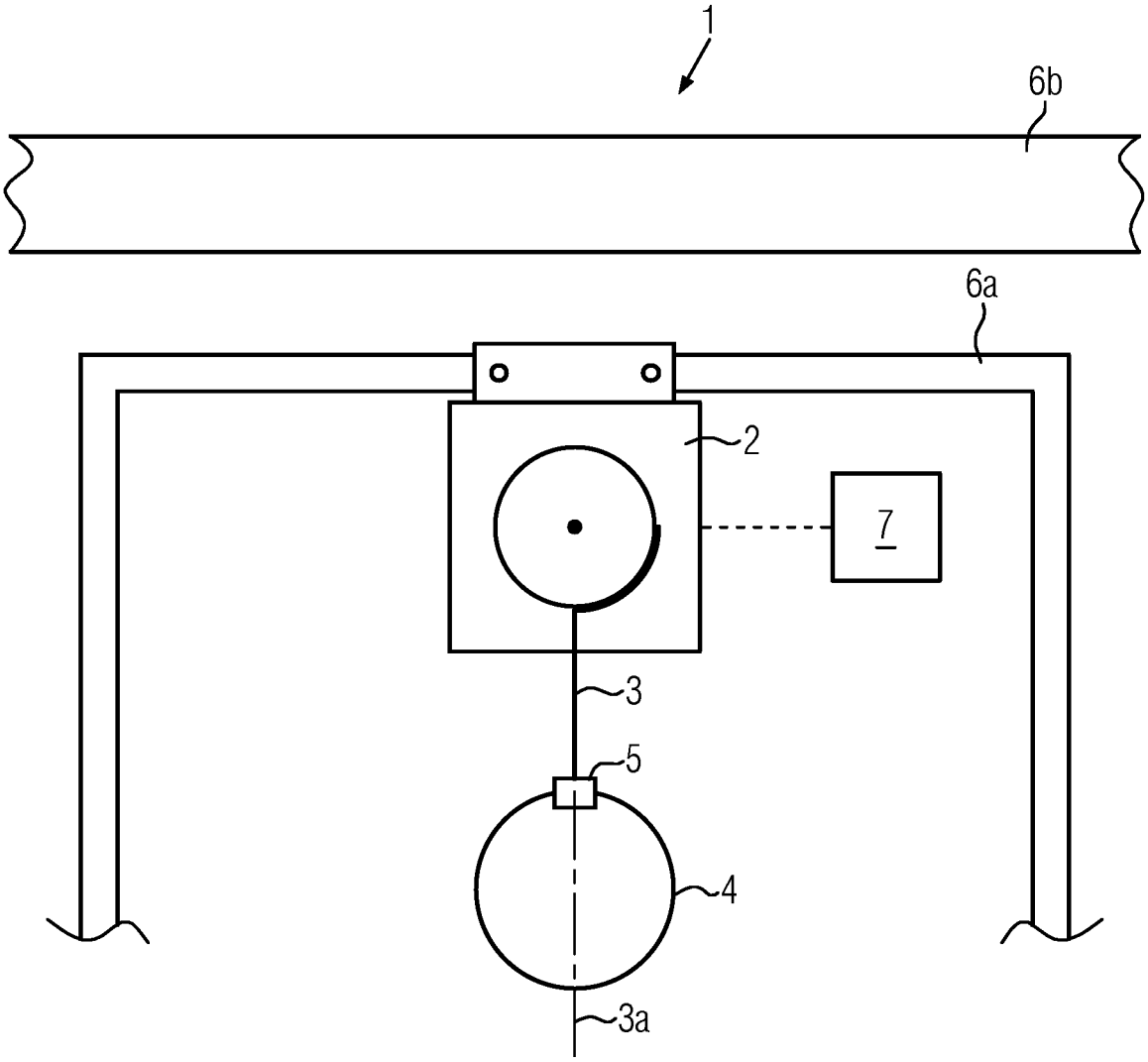
FIG. 1 illustrates a schematic and not-to scale view of a system according to the invention.

FIG. 1 shows a system 1 according to the invention comprising a winch 2, a cable 3, and an illumination component 4. A longitudinal axis 3*a* of the unwound and tensioned portion of the cable is also shown. The winch is configured to wind and/or unwind the cable. Moreover, a connector device 5 is schematically shown. The connector device 5 mechanically connects the cable and the illumination component in such a manner that at least part of the illumination component is rotationally decoupled from the cable in a connected state. The winch is here shown as being attached to and suspended from a framework 6*a*, but it may alternatively be attached to a ceiling 6*b* of a building, for example. Thus, the illumination component is suspended from the framework via the cable. The framework may be standing, e.g., in the form of a scaffold, as suggested in FIG. 1 or it may be suspended from the ceiling. The winch may comprise or be connected to an external control device 7 configured to control the operation of the winch and/or the illumination component. The system is configured to supply power and/or data to the illumination component via the cable. Details in this respect are provided below.

That is, different examples of how the cable, the illumination component, and the connector device of such a system may be configured and arranged, will be described below with reference to FIGS. 2 to 6. In said Figures the winch is not shown, so as to allow for a more detailed view of the connector device and how it interacts with the cable and the illumination component.

Figure 2:
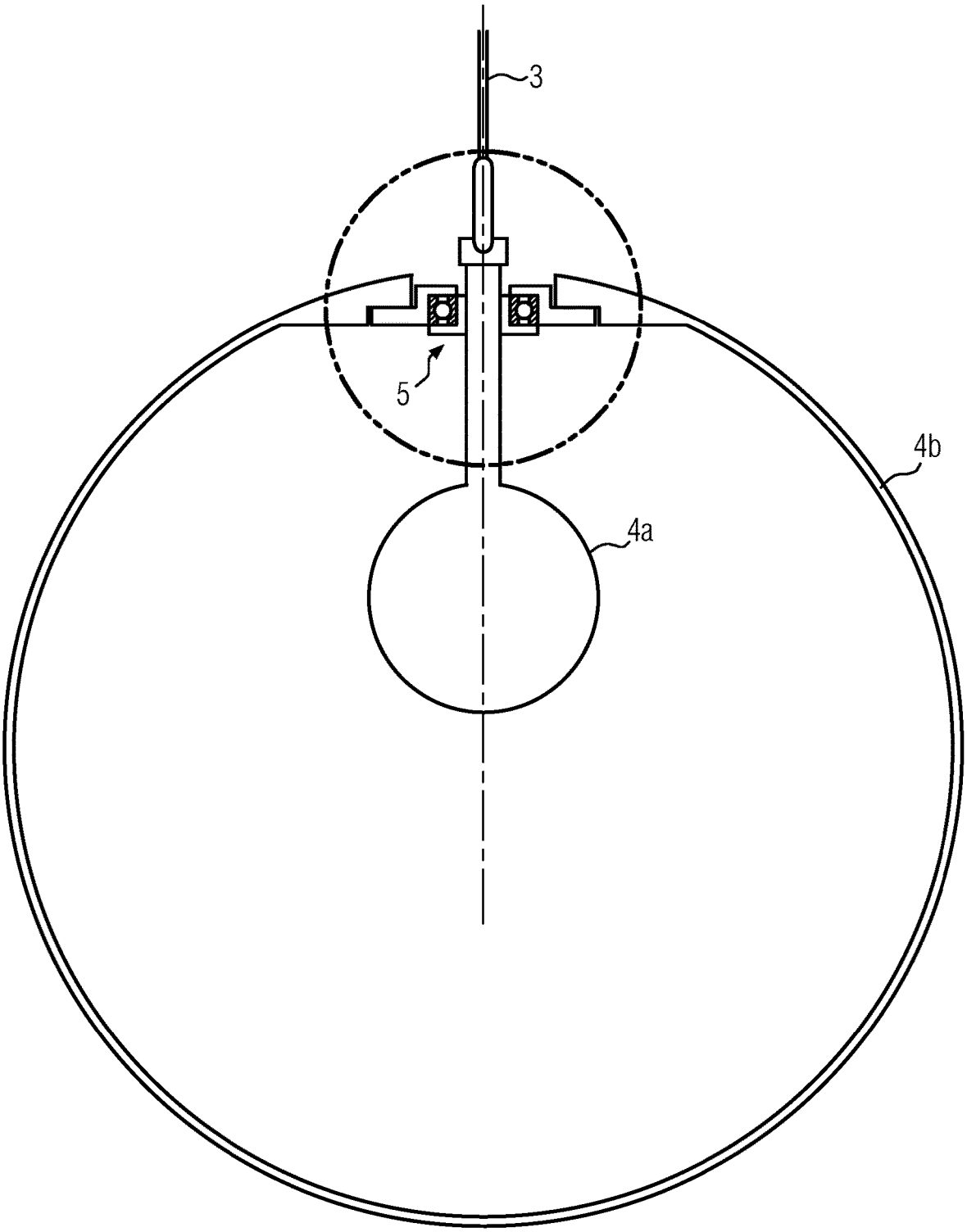
FIG. 2 illustrates a schematic and not-to scale view of the system according to a first embodiment.
Figure 3:
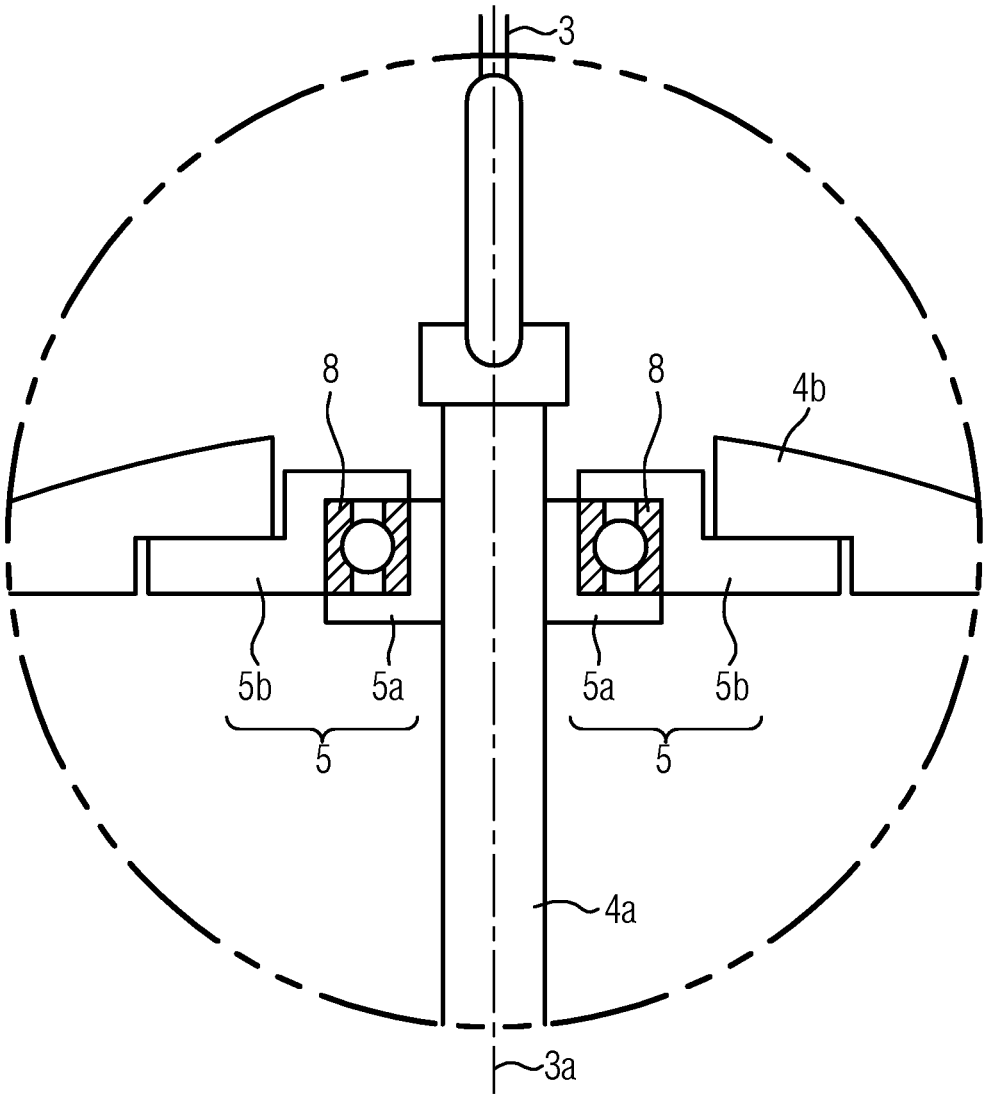
FIG. 3 illustrates a schematic and not-to scale view of the system according to the first embodiment.

FIGS. 2 and 3 show a first embodiment, in which the illumination component comprises an electrical apparatus, in particular, a lighting apparatus. In this case, the lighting apparatus comprises a first part 4*a* in the form of a light-emitting device. The lighting apparatus also comprises a second part 4*b*, in the present example in the form of a shell that at least partially encloses the light-emitting device. The shell may optionally be transparent or translucent so as to transmit part of the emitted light or it may be opaque and have openings through which the light is emitted.

As illustrated in FIG. 3, which is a more detailed view of the system shown in FIG. 2, the cable 3 and the light-emitting device 4*a* are attached to a first portion 5*a* of the connector device. In the present case, the cable is attached to the first portion of the connector device via the first part of the lighting apparatus, but it may also be directly attached to the first portion of the connector device. The second part 4*b* of the lighting apparatus, i.e., the shell, is attached to a second portion 5*b* of the connector device. The second portion is rotatably supported on the first portion via a bearing 8. However, it is equally possible to support the first portion on the second portion, depending on the geometry.

Thus, the connector device rotationally decouples the second part 4*b* of the lighting apparatus from the cable and from the first part 4*a* of the lighting apparatus.

That is, when the second part, in this case the shell, of the lighting apparatus rotates, the second portion of the connector device will rotate together with the shell. However, by means of the bearing, it is avoided that the rotation is transferred to the first portion of the connector device. The first part of the lighting apparatus and the cable are attached to the first portion of the connector device, but not to the second portion thereof or the second part of the lighting apparatus. Thus, the rotation will also not be translated to them. Therefore, the second part, here shell, of the lighting apparatus may rotate, but a rotation of the cable can be avoided. In view of this, the risk that the cable will be twisted around its longitudinal axis (of the unwound and tensioned portion) is reduced.

The cable may have wiring and a sheath. The wiring of the cable may be connected, for example via a plug connection, directly to wiring of the first part of the light-emitting device. Alternatively, the wiring of the cable and the wiring of the lighting apparatus may each be connected, for example via a plug connection, to wiring of the first portion of the connector device, such that the electrical contact between the cable and the light-emitting device may be obtained through the first portion of the connector device.

Figure 4:
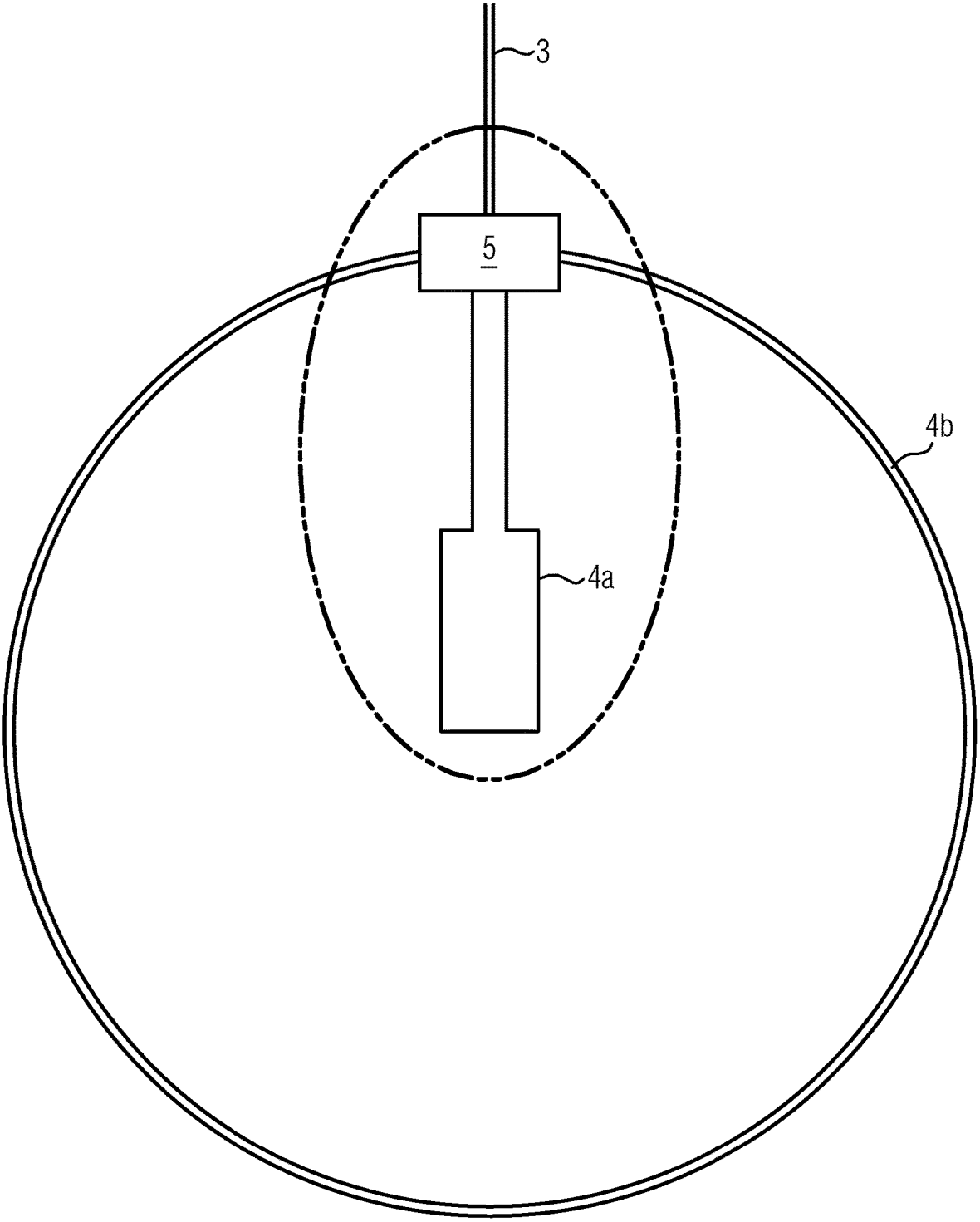
FIG. 4 illustrates a schematic and not-to scale view of the system according to a second embodiment.
Figure 5:
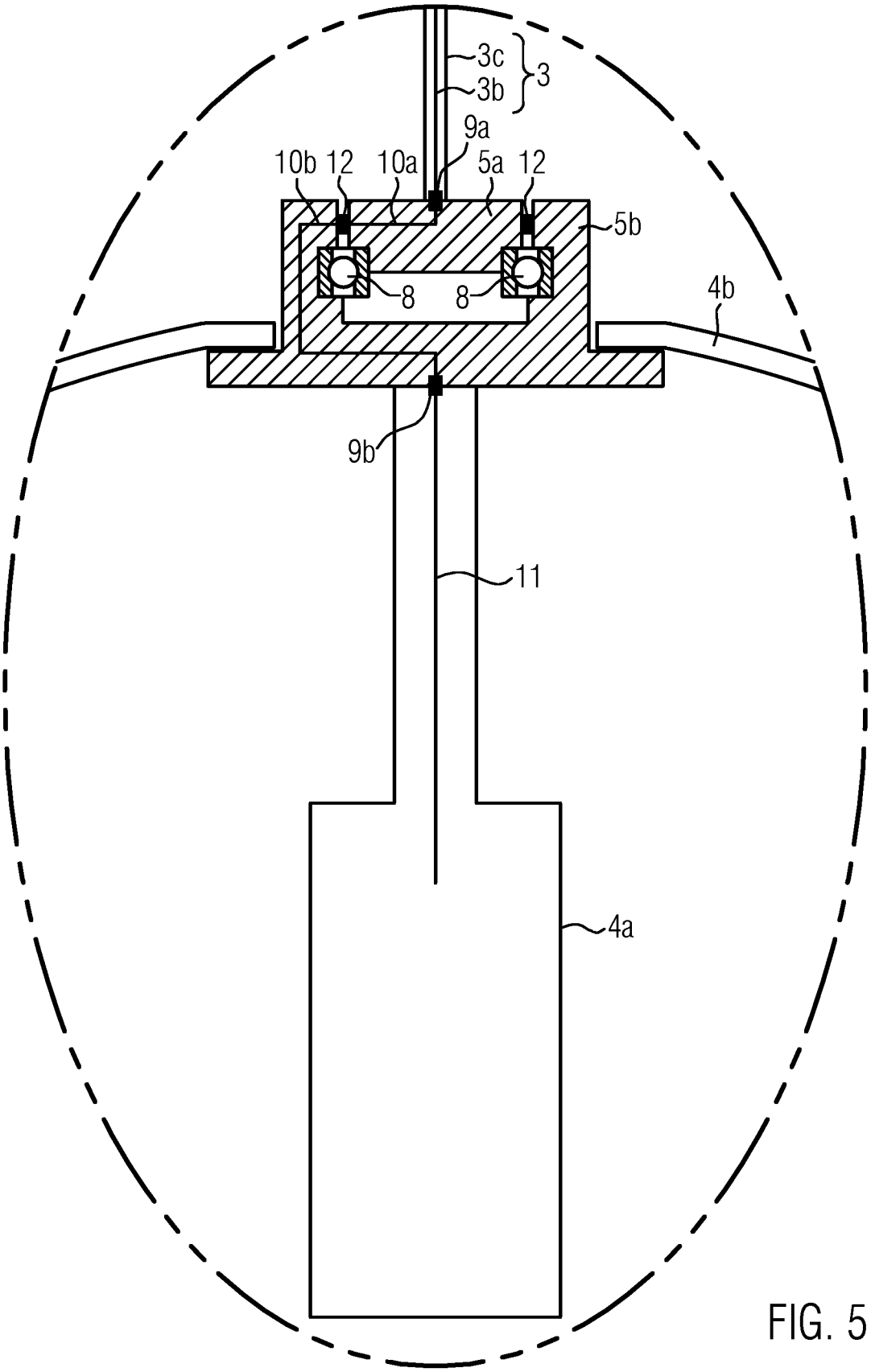
FIG. 5 illustrates a schematic and not-to scale view of the system according to the second embodiment.

An alternative embodiment is shown in FIGS. 4 and 5. Similar to the first embodiment, the illumination component comprises an electrical apparatus, in particular, a lighting apparatus. The lighting apparatus comprises a first part 4*a* in the form of a light-emitting device. The lighting apparatus also comprises a second part 4*b*, in the present example in the form of a shell that at least partially encloses the light-emitting device. The shell may optionally be transparent or translucent so as to transmit part of the emitted light, or it may be opaque and have openings through which the light is emitted.

As illustrated in FIG. 5, which is a more detailed view of the system shown in FIG. 4, the cable 3 is attached to a first portion 5*a* of the connector device. The first part 4*a* and second part 4*b*, i.e., the light-emitting device and the shell, are each attached to a second portion 5*b* of the connector device.

Thus, the connector device rotationally decouples the first part 4*a* and the second part 4*b* of the lighting apparatus from the cable.

That is, when the second part of the lighting apparatus, in this case the shell, of the lighting apparatus rotates, the first part of the lighting apparatus and second portion of the connector device will rotate together with the shell. However, by means of the bearing, it is avoided that the rotation is transferred to the first portion of the connector device. The cable is attached to the first portion of the connector device, but not to the second portion thereof or the first and second parts of the lighting apparatus. Thus, the rotation will also not be translated to the cable. Therefore, the first and second part of the lighting apparatus may rotate, but a rotation of the cable is avoided. In view of this, the risk that the cable will twist around its longitudinal axis is reduced.

The cable in this case has wiring 3*b* and a sheath 3*c*. In this embodiment, the wiring of the cable may be connected, for example via a plug connection 9*a*, to the wiring 10*a* of the first portion of the connector device. The wiring 11 of the light-emitting device may be connected, for example via a plug connection 9*b*, to wiring 10*b* of the second portion of the connector device.

The first and second portion of the connector device may be electrically connected via a gliding contact 12, for example a slip ring. Alternatively, or in addition, the connector device may comprise an interface for wirelessly transmitting power and/or data, for example electrical signals between the first portion and the second portion of the connector device. In the first alternative, an electrical contact between the cable and the light-emitting device may be obtained through the first portion and the second portion of the connector device. The system may be configured to provide power and/or data via the cable and the electrical contact to the light-emitting device. In the second alternative, the system may be configured to provide power and/or data via the cable and the contactless transfer interface. Accordingly, in this case power and/or data can be provided to the light-emitting device even when no electrical connection with the cable is established.

Figure 6:
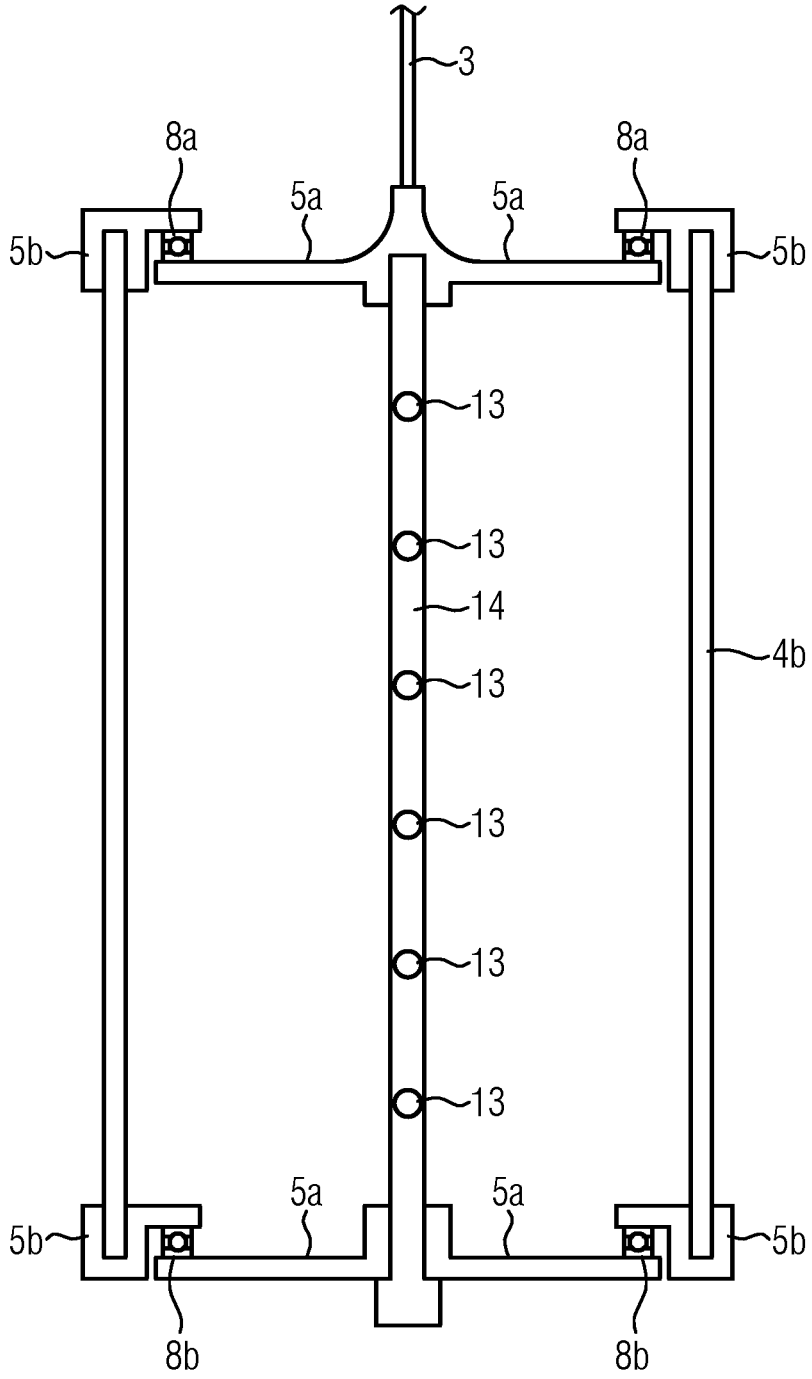
FIG. 6 illustrates a schematic and not-to scale view of the system according to a third embodiment.

It should be noted that the connector device in all embodiments may have more than one bearing. An example where the connector device has two bearings is shown in FIG. 6. In the example of FIG. 6, a second part 4*b* of the illumination component, in this example a lighting apparatus, is rotatably supported at two different locations by the connector device.

The first part 4*a* of the lighting apparatus, i.e., the light-emitting device, includes at least one, in this example several, light-emitting elements 13, like LEDs or light bulbs, attached to a support element 14. As shown in FIG. 6, the support element 14 has an elongated shape and the light-emitting elements are provided at different positions along the length of the elongated support element. It should be noted that any other type of light-emitting device may be used, for example a fluorescent tube. The second part 4*b* of the lighting apparatus, i.e., the shell, also has an elongated shape and is arranged so as to at least partially encase the support element.

The connector device comprises a first portion 5*a* and two bearings 8*a* and 8*b*. As can be seen in FIG. 6, the first portion of the connector device has at least a first and a second piece. The first and second pieces are each attached to the first part 4*a* of the lighting apparatus, in this example to the support element, at different positions along the length of the support element, in particular, at different ends of the support element. The second portion 5*b* of the connector device also has at least a first and a second piece. The respective first pieces of the first and second portion of the connector device are connected via bearing 8*a* and the respective second pieces of the first and second portion of the connector device are connected via bearing 8*b*.

In the example shown in FIG. 6, the first piece of the first portion of the connector device is arranged at the end of the support element that is closer to the cable. The second piece and the second piece of the first portion of the connector device is arranged at the end of the support element that is further from cable.

Thus, in the system as shown in FIG. 6, the first and second portion of the connector device and the bearings are arranged such that the second portion of the connector device is rotatably supported at two different locations, such that also the second part of the lighting apparatus is supported at two different locations.

It is to be understood that in addition to or alternatively to the above described arrangements, the connector device may have more than one bearing and be configured such that the first and second part of the illumination component are rotationally decoupled from the cable independently of each other, for example via separate bearings.

Moreover, alternatively or in addition to any of the above described arrangements, the illumination component may have more than two parts. In such a case, it is possible that the connector device is configured such that other parts than the first and/or second part of the illumination component are rotationally decoupled from the cable, in particular, that they are decoupled from the cable independently from the first and/or second part.

Although the previously discussed embodiments and examples of the present invention have been described separately, it is to be understood that some or all of the above-described features can also be combined in different ways. The above-discussed embodiments are not intended as limitations, but serve as examples, illustrating features and advantages of the invention.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples. The term "about" as used herein serves to reasonably encompass or describe minor variations in numerical values measured by instrumental analysis or as a result of sample handling. Such minor variations may be in the order of ±0-25, ±0-10, ±0-5, or ±0-2.5, % of the numerical values. Further, The term "about" applies to both numerical values when associated with a range of values. Moreover, the term "about" may apply to numerical values even when not explicitly stated.

Generally, as used herein a hyphen "-" or dash "—" in a range of values is "to" or "through"; a ">" is "above" or "greater-than"; a "≥" is "at least" or "greater-than or equal to"; a "<" is "below" or "less-than"; and a "≤" is "at most" or "less-than or equal to." On an individual basis, each of the aforementioned applications for patent, patents, and/or patent application publications, is expressly incorporated herein by reference in its entirety in one or more non-limiting embodiments.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and or in combination and provides adequate support for specific embodiments within the scope of the appended claims.

The present invention has been described herein in an illustrative manner, and it is to be understood that the terminology which has been used is intended to be in the nature of words of description rather than of limitation. Many modifications and variations of the present invention are possible in light of the above teachings. The present invention may be practiced otherwise than as specifically described within the scope of the appended claims. The subject matter of all combinations of independent and dependent claims, both single and multiple dependent, is herein expressly contemplated.

What is claimed is:

1. A system, comprising an illumination component comprising an electrical apparatus;

a cable configured to be mechanically connected to the illumination component;

a winch configured to wind and/or unwind the cable; and a connector device comprising a bearing and configured to mechanically connect the illumination component to the cable in such a manner that, in a connected state, at least part of the illumination component is rotationally decoupled from the cable via the bearing, wherein the system is configured to supply power and/or data to the illumination component via the cable;

wherein the illumination component comprises a first part and a second part, and wherein the connector device is configured to rotationally decouple the first part and the second part from the cable or to rotationally decouple only the second part from the cable.

2. The system according to claim 1, wherein only the second part is decoupled from the cable, and wherein the second part has a bigger mass and/or moment of inertia than the first part.

3. The system according to claim 1, wherein the cable is attached to a first portion of the connector device and the at least part of the illumination component that is rotationally decoupled from the cable via the bearing is attached to a second portion of the connector device, the first and second portion of the connector device being freely rotatable with respect to each other.

4. The system according to claim 3, wherein the first portion of the connector device is attached to the first part of the illumination component and the second portion of the connector device is connected to the second part of the illumination component.

5. The system according to claim 3, wherein the illumination component comprises an electrical apparatus and the system is configured to transmit power and/or data from the cable to the electrical apparatus via the connector device.

6. The system according to claim 5, wherein the connector device comprises an electrical contact electrically connecting the first portion and the second portion of the connector device, and/or a contactless transfer interface configured to transfer power and/or data between the first portion and the second portion of the connector device.

7. The system according to claim 1, wherein the illumination component comprises an electrical apparatus and the first part of the illumination component comprises parts of the electrical apparatus to be supplied with power and/or data via the cable.

8. The system according to claim 7, wherein the parts of the electrical apparatus to be provided with power and/or signals via the cable have an electrical connection, the connection bypassing the connector device.

9. The system according to claim 8, wherein the electrical connection comprises a direct connection between a wiring of the cable and a wiring of the electrical apparatus.

10. The system according to claim 1, wherein the illumination component comprises a lighting apparatus, which comprises a light-emitting device and a shell;

wherein the shell at least partially encloses the light-emitting device; and wherein the first part comprises the light-emitting device and the second part comprises the shell.

11. The system according to claim 1, wherein the illumination component comprises a lighting apparatus comprising a light-emitting device and a shell, wherein the shell at least partially encloses the light-emitting device;

wherein the connector device is configured to rotationally decouple the shell from the cable; and wherein the system is configured such that power and/or data are provided from the cable to the light-emitting device via an electrical contact and/or via a contactless transfer interface for transferring power and/or data.

12. The system according to claim 11, wherein the connector device comprises the electrical contact and/or contactless transfer interface for transferring power and/or data.

13. The system according to claim 1, wherein the illumination component comprises at least one of a light-reflecting element, a diffusor, a fluorescent element, or a phosphorescent element.

14. The system according to claim 1, wherein, when the system is assembled and mounted, the winch is mounted to a building.

15. The system according to claim 1, wherein, when the system is assembled and mounted, the cable is tensioned, and/or wherein, when the system is assembled and mounted, the illumination component is suspended, via the cable, from the winch.

* * * * *